US007086470B2

(12) United States Patent
Diamond et al.

(10) Patent No.: US 7,086,470 B2
(45) Date of Patent: Aug. 8, 2006

(54) SYSTEM AND METHOD FOR WELLBORE CLEARING

(75) Inventors: Lawrence W. Diamond, Rockwall, TX (US); Monty H. Rial, Dallas, TX (US); Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 164 days.

(21) Appl. No.: 10/764,192

(22) Filed: Jan. 23, 2004

(65) Prior Publication Data

US 2005/0161221 A1 Jul. 28, 2005

(51) Int. Cl.
*E21B 43/00* (2006.01)

(52) U.S. Cl. ..... 166/311; 166/177.7

(58) Field of Classification Search ..... 166/311, 166/312, 177.7; 175/89
See application file for complete search history.

(56) References Cited

U.S. PATENT DOCUMENTS

| | | | | |
|---|---|---|---|---|
| 202,570 | A * | 4/1878 | Wray | 166/369 |
| 664,628 | A * | 12/1900 | Ecaubert | 175/5 |
| 1,017,847 | A | 2/1912 | Carl | |
| 1,410,827 | A * | 3/1922 | Muehl | 166/312 |
| 1,444,180 | A | 2/1923 | Gartling | |
| 2,329,913 | A | 9/1943 | Kizziar | |
| 2,710,739 | A * | 6/1955 | Jourdain | 175/89 |
| 2,825,411 | A * | 3/1958 | Keltner | 166/177.7 |
| 3,459,169 | A * | 8/1969 | Mcnulty | 125/21 |
| 3,710,877 | A * | 1/1973 | Michasiw | 175/18 |
| 4,552,220 | A | 11/1985 | Jones | |
| 6,575,255 | B1 | 6/2003 | Rial et al. | |
| 6,591,922 | B1 | 7/2003 | Rial et al. | |
| 6,595,301 | B1 | 7/2003 | Diamond et al. | |
| 6,595,302 | B1 | 7/2003 | Diamond et al. | |
| 6,644,422 | B1 | 11/2003 | Rial et al. | |
| 6,722,452 | B1 | 4/2004 | Rial et al. | |
| 6,851,479 | B1 | 2/2005 | Zupanick et al. | |
| 2004/0040749 | A1 * | 3/2004 | Terry et al. | 175/320 |

FOREIGN PATENT DOCUMENTS

WO WO 00/58602 10/2000

OTHER PUBLICATIONS

Notification of Transmittal of the International Search Report and the Written Opinion of the International Searching Authority, or the Declaration (3 pages), International Search Report (4 pages), and Written Opinion of the International Searching Authority (6 pages) for International Application No. PCT/US2005/001760 mailed Apr. 5, 2005.

(Continued)

*Primary Examiner*—William Neuder
(74) *Attorney, Agent, or Firm*—Fish & Richardson P.C.

(57) ABSTRACT

In accordance with one embodiment, a method is provided for clearing the inside of a wellbore including inserting a wellbore clearing system into the wellbore. The wellbore clearing system includes an anchor adapted to be positioned within the wellbore, an agitator operable to be moved relative to the interior surface of the wellbore, and a linkage coupling the agitator to the anchor. The method further includes securing the anchor within the wellbore and moving the agitator relative to the interior surface of the wellbore. The movement of the agitator is operable to at least partially eliminate a restriction to a flow of minerals or other resources in the wellbore.

43 Claims, 5 Drawing Sheets

OTHER PUBLICATIONS

Database WPI, Section Ch., Week 198006, Derwent Publications Ltd., London, GB; AN 1980-10691C, XP-002321755 and Su 663 822 A (Hydromech Sanitary), Abstract, May 29, 1979 (1 page).

Notification of Transmittal of the International Preliminary Report on Patentability (1 page) and International Preliminary Report on Patentability (12 pages) for International Application No. PCT/US2005/001760 mailed Jan. 17, 2006.

* cited by examiner

SYSTEM AND METHOD FOR WELLBORE CLEARING

TECHNICAL FIELD OF THE INVENTION

The present invention relates generally to systems and methods for the recovery of subterranean resources and, more particularly, to a system and method for wellbore clearing.

BACKGROUND OF THE INVENTION

Subterranean drilling and production of minerals and fluids may produce substantial quantities of debris within wellbores. For example, small particles of minerals, sometimes called "fines," can accumulate and disrupt the process of extracting minerals and other resources from the wellbores. Furthermore, solids may be present within a wellbore, which may at least partially restrict the flow of minerals and other resources within the wellbore. As a result of the buildup of fines within wellbores and the potential for solids to at least partially restrict the flow of minerals and other resources within a wellbore, techniques are need to remove fines from the wellbores and move solids within the wellbores to at least partially eliminate any flow restrictions in the wellbore.

SUMMARY OF THE INVENTION

The present invention provides a system and method for wellbore clearing that substantially eliminates or reduces at least some of the disadvantages and problems associated with conventional systems and methods for clearing wellbores.

In accordance with certain embodiments, a system for clearing the inside of a wellbore includes an anchor adapted to be positioned within the wellbore and an agitator coupled to the anchor. The agitator is operable to move relative to the interior surface of the wellbore, the movement of the agitator operable to at least partially eliminate a restriction to a flow of minerals or other resources in the wellbore. The system further includes a linkage adapted to couple the agitator to the anchor and a drive mechanism coupled to the agitator and operable move the agitator relative to the interior surface of the wellbore.

In accordance with other embodiments, a method is provided for clearing the inside of a wellbore including inserting a wellbore clearing system into the wellbore. The wellbore clearing system includes an anchor adapted to be positioned within the wellbore, an agitator operable to be moved relative to the interior surface of the wellbore, and a linkage coupling the agitator to the anchor. The method further includes securing the anchor within the wellbore and moving the agitator relative to the interior surface of the wellbore. The movement of the agitator is operable to at least partially eliminate a restriction to a flow of minerals or other resources in the wellbore.

Technical advantages of particular embodiments of the present invention include a system and method that facilitate the removal of fines located on or near the bottom of a wellbore that may otherwise be difficult to remove. Another technical advantage of one embodiment of the present invention includes a system and method for moving solids in the flow path of a wellbore, so as to at least partially eliminate flow restrictions in the wellbore. Yet another technical advantage of particular embodiments of the present invention includes a system for clearing the inside of a wellbore whose components are sufficiently durable and reliable to be placed in the wellbore for extended periods of time without the need to be removed for repair or replacement. Still another technical advantage of particular embodiments of the present invention includes a system and method that can be utilized to clear pipes, conduit, tubing, or the like.

Other technical advantages will be readily apparent to one skilled in the art from the figures, descriptions, and claims included herein. Moreover, while specific advantages have been enumerated above, various embodiments may include all, some, or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION OF THE INVENTION

Figure 1:
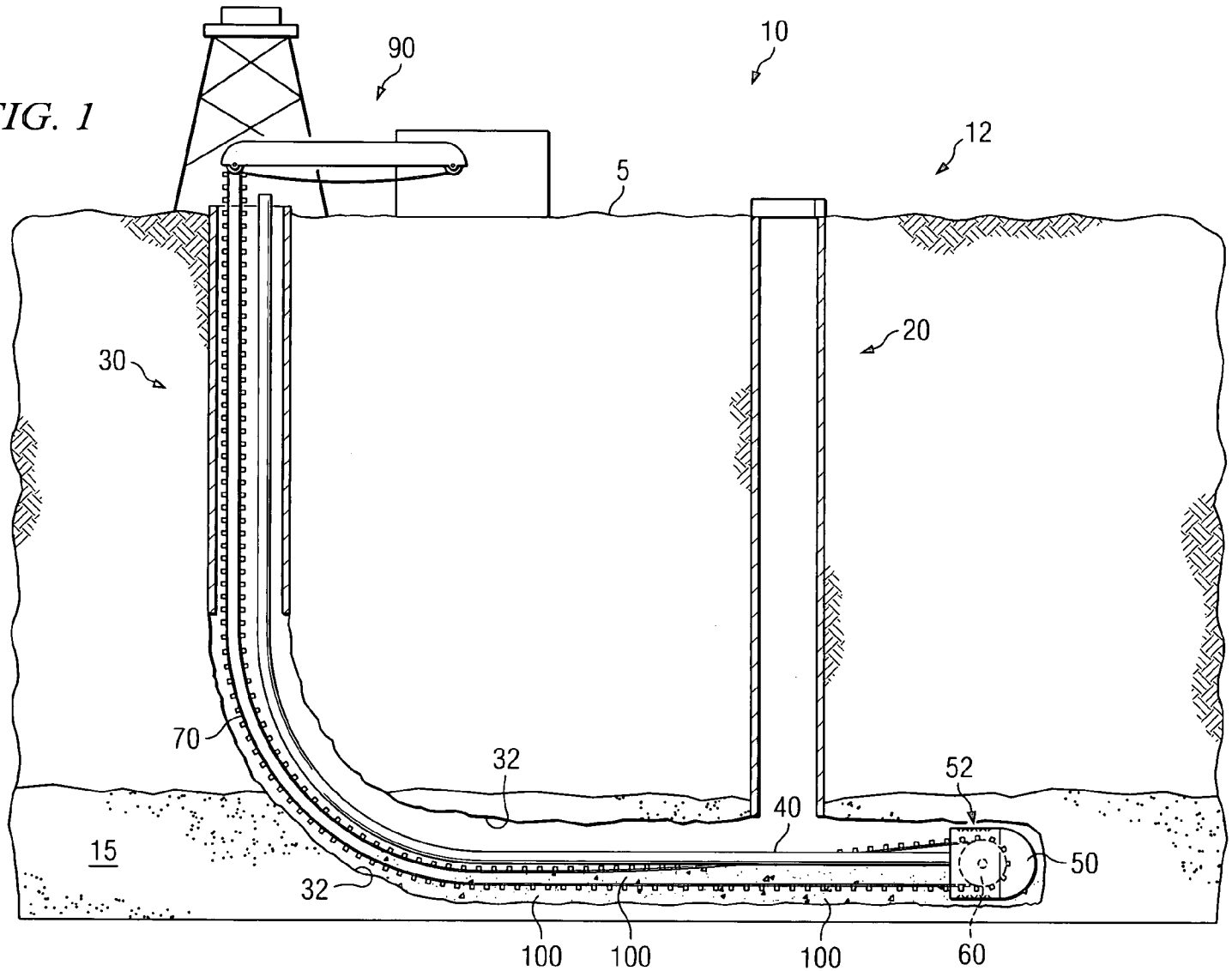
FIG. 1 illustrates an example system for wellbore clearing.

FIG. 1 illustrates an example wellbore clearing system 10 for removing "fines" 100 from a well or pipe system, such as dual-well system 12. In a certain embodiment, dual-well system 12 includes a substantially vertical wellbore 20 and an articulated wellbore 30 where each wellbore extends from surface 5 to penetrate subterranean zone 15. However, system 10 may be used in vertical wells, slant wells, or any other types of wells or well systems. Furthermore, system 10 may be used for clearing the inside of any suitable pipes, conduits, tubing, or the like. Use of the term "wellbore" is meant to include these alternatives. Subterranean zone 15 may comprise an oil or gas reservoir, a coal seam, or any other appropriate subterranean zone. Subterranean zone 15 may be accessed to remove and/or produce water, hydrocarbons, and other fluids in subterranean zone 15 or to treat minerals in subterranean zone 15 prior to mining operations.

In certain embodiments, a wellbore, such as articulated wellbore 30, may contain fluids and fines as a result of the drilling process and the movement of mineral resources from subterranean zone 15 into wellbore 30. For example, when drilling into a coal seam, coal fines may be produced. Furthermore, coal fines are produced from the coal seam as fluids and gases are removed from the coal seam. System 10 is used to remove these coal fines from wellbore 30. In other embodiments, system 10 may be used to facilitate the movement of solids which may be substantially larger than fines 100, such as pieces of subterranean zone 15 which may fall into wellbore 30 as a result of a wellbore failure and restrict the flow of minerals or other resources in wellbore 30, to at least partially eliminate any restriction in the flow of minerals or other resources in wellbore 30.

System 10 includes a workstring 40, an anchor 50, a linkage 60, an agitator 70, and a drive mechanism 90. In a particular embodiment, anchor 50 is temporarily coupled to workstring 40 so that workstring 40 may be used to position anchor 50 within a wellbore, such as articulated wellbore 30. Once anchor 50 is positioned, workstring 40 may be disengaged from anchor 50 and removed from wellbore 30. In other embodiments, workstring 40 may remain in place and act as an anchor for a pulley, such as the pulley of linkage 160 described below, or as a guide tube or conduit for and advancing or retreating agitator, such as agitators 170 and 370 described below. Linkage 60, discussed in more detail with reference to FIGS. 3A through 3C, couples agitator 70 to anchor 50. Anchor 50 may be any device operable to "anchor" linkage 60 and agitator 70 within wellbore 30, such as a bridge plug or other suitable restraining device. In a certain embodiment, agitator 70 runs from linkage 60, coupled to anchor 50, through wellbore 30, and up to surface 5 where it may be coupled to a manual or automatic drive mechanism 90. Movement of agitator 70 relative to a wellbore surface 32 disrupts fines 100, which may be disposed on or near a surface 32 of wellbore 30. This disruption facilitates the "mixing" of fines 100 with the fluid contained in wellbore 30, thereby allowing fines 100 to be removed from wellbore 30 with the fluid. In other embodiments, movement of agitator 70 relative to wellbore surface 32 may facilitate the movement of solids which may be substantially larger than fines 100, such as pieces of subterranean zone 15 which may fall into wellbore 30 as a result of a wellbore failure and restrict the flow of minerals or other resources in wellbore 30, to at least partially eliminate any restriction in the flow of minerals or other resources in wellbore 30.

Figure 2:
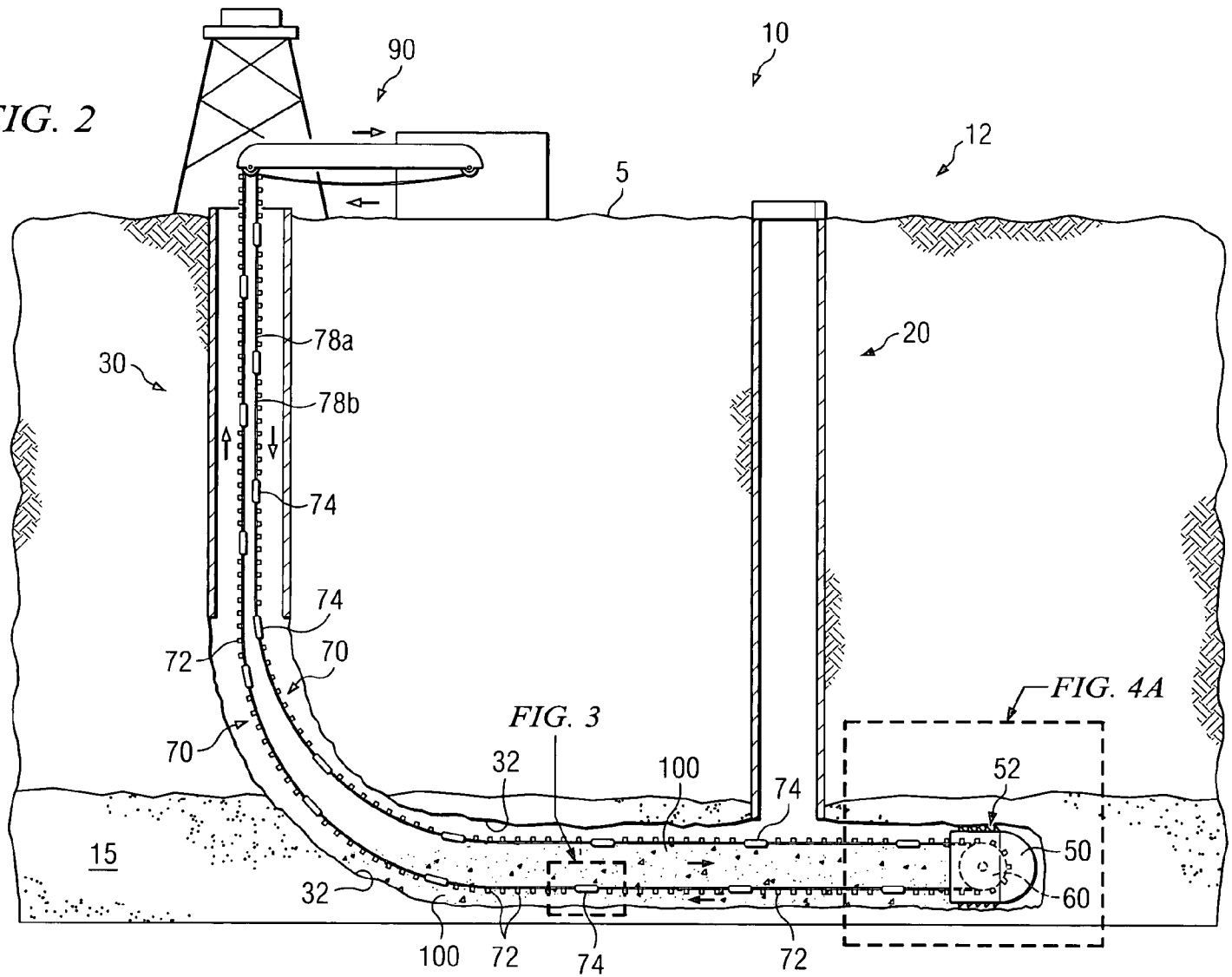
FIG. 2 illustrates the wellbore clearing system of FIG. 1 after installation of the system is completed.

FIG. 2 illustrates wellbore clearing system 10 of FIG. 1 after installation of system 10 is completed. As described above, in a certain embodiment, anchor 50 may be positioned within wellbore 30 using workstring 40. In FIG. 2, anchor 50 has been positioned within wellbore 30 using workstring 40 and workstring 40 has been disengaged from anchor 50 and removed from wellbore 30. In a particular embodiment, anchor 50 may be secured within wellbore 30 using teeth 52 that may extend from anchor 50 once it has been positioned within wellbore 30. In this particular embodiment, anchor 50 is referred to as a "bridge plug." Teeth 52 may be extended from anchor 50 to engage surface 32 of wellbore 30 once anchor 50 is positioned in wellbore 30. Teeth 52 may be retracted into the body of anchor 50 when anchor 50 is being positioned in wellbore 30 or when anchor 50 is being removed from wellbore 30. Teeth 52 are shown in a retracted position in FIG. 1, where anchor 50 is being positioned in wellbore 30 using workstring 40. Although teeth 52 are illustrated, any other suitable mechanism for securing anchor 50, and thereby anchoring agitator 70 within wellbore 30, may be used. For example, anchor 50 may comprise an inflatable "bladder" that is inserted into wellbore 30 in an un-inflated or under-inflated state and then inflated to secure anchor 50 within wellbore 30.

Referring still to FIG. 2, agitator 70 is coupled to anchor 50 via linkage 60. Agitator 70 runs up through wellbore 30 and out through surface 5 to a drive mechanism 90. Drive mechanism 90 provides the motive force for the movement of agitator 70 within wellbore 30. Drive mechanism 90 may comprise a hand-operated crank, a motor, or any other device operable to move agitator 70 relative to the interior surface 32 of wellbore 30. The movement of agitator 70 with respect to surface 32 of wellbore 30 causes fines 100 to mix with fluid contained within wellbore 30. To facilitate this mixing, in certain embodiments agitator 70 comprises extensions 72 which further disturb the fluid and fines in wellbore 30, thereby facilitating mixing. In other embodiments, movement of agitator 70 relative to wellbore surface 32 may facilitate the movement of solids which may be substantially larger than fines 100, such as pieces of subterranean zone 15 which may fall into wellbore 30 as a result of a wellbore failure and restrict the flow of minerals or other resources in wellbore 30, to at least partially eliminate any restriction in the flow of minerals or other resources in wellbore 30.

Figure 3:
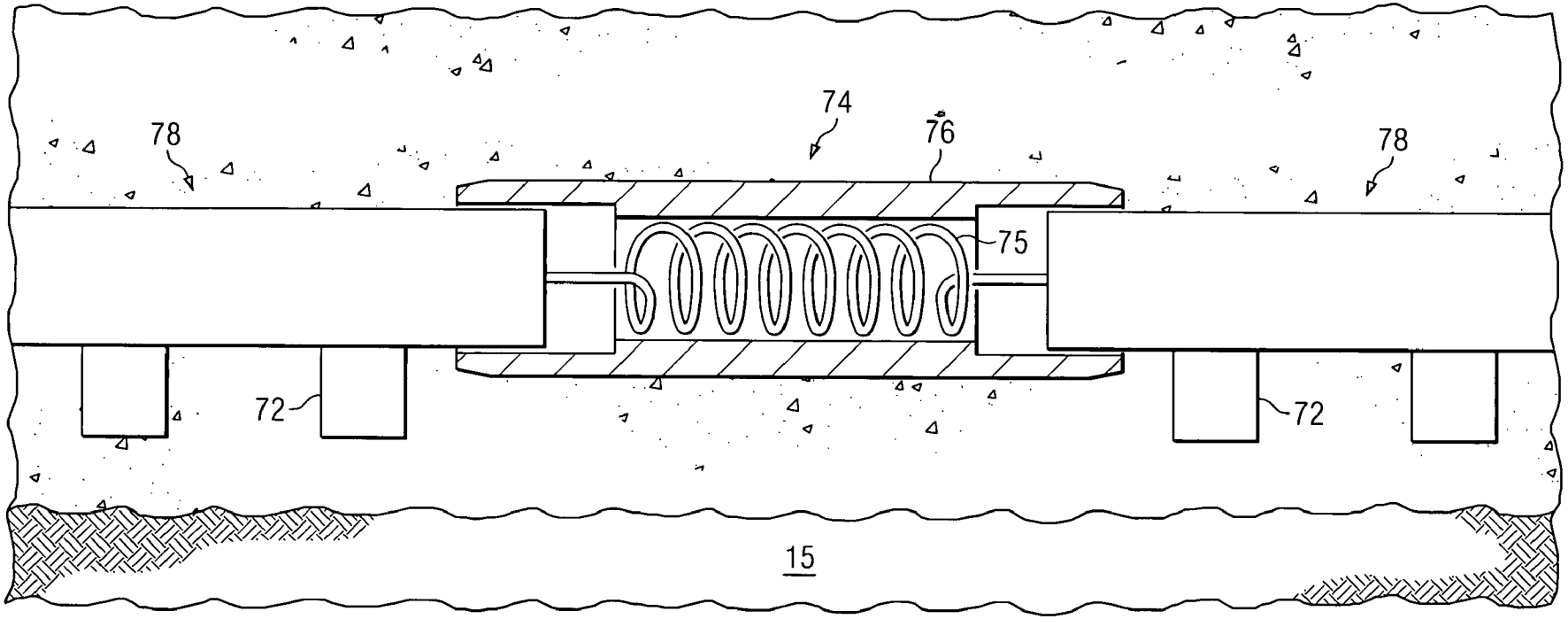
FIG. 3 illustrates a detailed view of an example expansion joint.

In certain embodiments, agitator 70 may include expansion joints 74, illustrated in FIG. 3, used to couple portions 78 of agitator 70 in order to allow one or more portions 78 to move independently of other portions 78 to prevent agitator 70 from becoming "jammed" in the event of a wellbore failure. Expansion joints 74 may be made from any appropriate expandable/contractible material, such as a spring 75, which can expand or contract in response to movement of agitator 70. Expansion joint 74 may also include a protective sleeve 76 to prevent the expandable/contractible material, such as spring 75, from becoming clogged by debris, such as fines or solids, within wellbore 30.

Referring again to FIG. 2, the movement of agitator 70 may cause different portions 78 to move relative to each other. For example, the movement of agitator 70 may be restricted due to a wellbore collapse where debris falls on and around agitator 70. The total weight of this debris over the length of agitator 70 may prevent agitator 70 from being easily moved. However, the weight of the debris which falls on each portion 78 may be small enough that each portion 78 may be moved independently of each other portion 78 due to the coupling of portions 78 with expansion joints 74. In this situation, for example, portion 78*a*, closest to surface 5, may be easier to move than the remaining portions 78 of agitator 70. Therefore, portion 78*a* can be moved first to move any debris which has fallen on or around portion 78*a*. Once the debris is moved from portion 78*a*, portion 78*b* may become easier to move since less total debris weight is on or around agitator 70. Similarly, once the debris is moved on or around portion 78*b*, portion 78*c* may become easier to move. In this manner, each remaining portion 78 may be moved to move debris, such that the movement of successively more portions 78 of agitator 70, as they progress further into wellbore 30, becomes less restricted, thereby helping to clear the obstructions, such as those caused by a wellbore 30 collapse, that may cause agitator 70 to "jam" within wellbore 30. Example configurations of agitator 70, expansion joints 74, linkage 60, and extensions 72 are discussed in more detail with reference to FIGS. 4A through 4C.

In certain embodiments, anchor 50, linkage 60, and agitator 70 may be disposed within wellbore 30, or any other type of wellbore, for use over an extended period of time. As such, these components may be constructed of sufficiently durable and reliable materials, including, but not limited to, wire rope or chains, so that they may be disposed within wellbore 30 for use over an extended period of time without the need to be removed from wellbore 30 for repair or replacement during that time. Anchor 50, linkage 60, and agitator 70 may also be designed and constructed to withstand the corrosive effects of the minerals and fluids that may collect in wellbore 30.

Figure 4A:
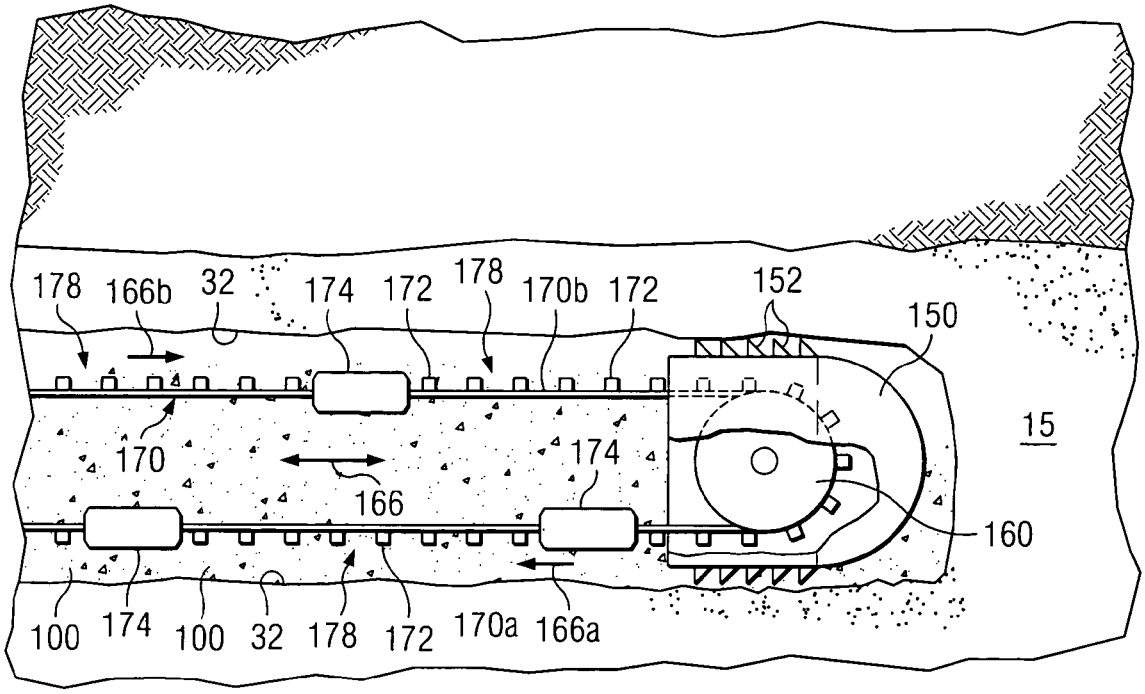
FIGS. 4A through 4C illustrate detailed views of example agitators and linkages of an example wellbore clearing system.
Figure 4B:
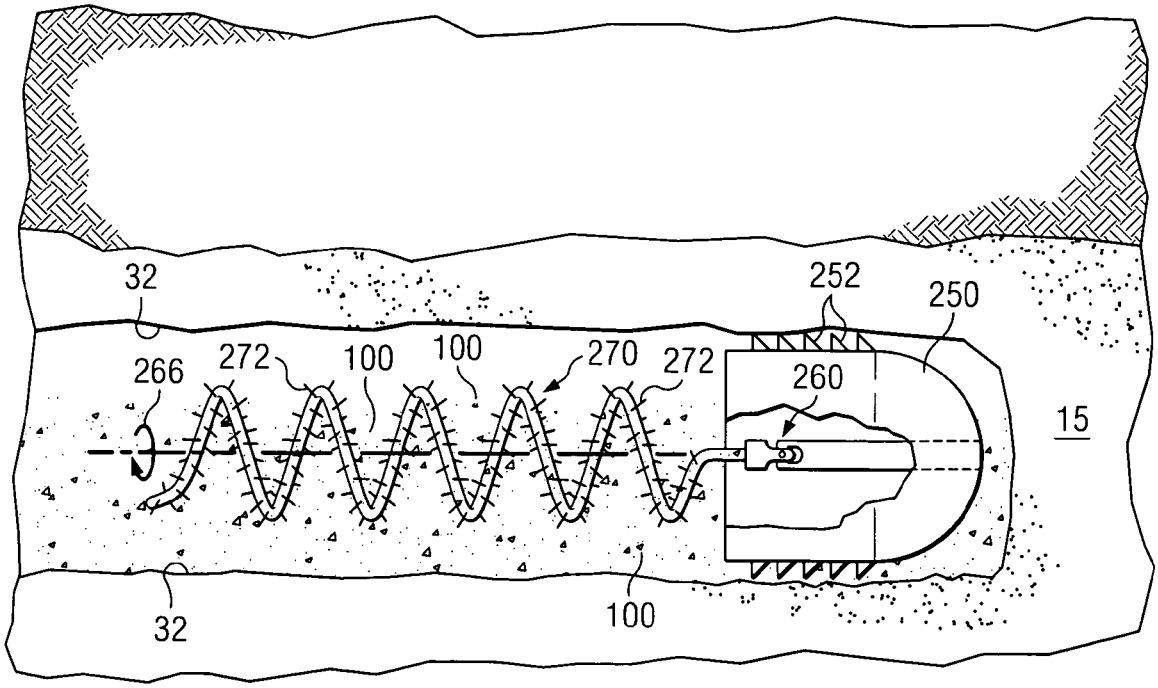
Figure 4C:
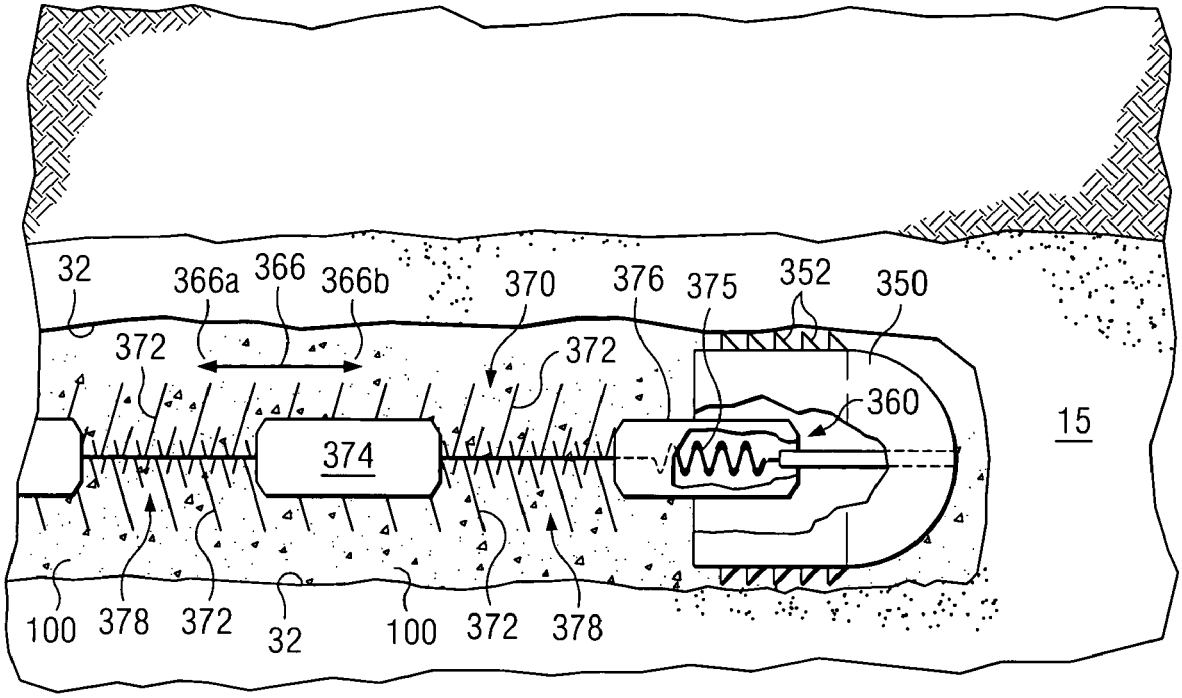

FIGS. 4A through 4C illustrate alternative embodiments of anchor 50, linkage 60, and agitator 70. FIG. 4A illustrates the mixing of fines 100 with fluid contained in wellbore 30. In one example embodiment, agitator 170 may comprise a wire, cable, belt, chain, or the like coupled between drive mechanism 90 and linkage 160. Linkage 160 may comprise a pulley, which may rotate in response to "conveyor-like" movement of agitator 170 along its longitudinal axis 166.

For example, the "advancing" portion 170*b* of agitator 170 may move in longitudinal direction 166*b*, while the "retreating" portion 170*a* of agitator 170 may move in the opposite longitudinal direction 166*a* as agitator 170 rotates around the pulley of linkage 160. In certain embodiments, workstring 40 may remain in place after anchor 150 is secured in wellbore 30 and act as an anchor for the pulley of linkage 160 and/or a guide tube or conduit for agitator 170.

Similar to the discussion above, fines 100 are disrupted through the movement of agitator 170 relative to wellbore surfaces 32. Extensions 172 facilitate the disruption of fines 100 such that fines 100 mix with fluid contained within wellbore 30. Extensions 172 may comprise raised "nubs," teeth, paddles, or any other suitable protrusions from agitator 170. In other embodiments, movement of agitator 170 relative to wellbore surface 32 may facilitate the movement of solids which may be substantially larger than fines 100, such as pieces of subterranean zone 15 which may fall into wellbore 30 as a result of a wellbore failure and restrict the flow of minerals or other resources in wellbore 30, to at least partially eliminate any restriction in the flow of minerals or other resources in wellbore 30.

In certain embodiments, similar to the discussion above with respect to FIGS. 2–3, agitator 170 may include expansion joints 174 used to couple portions 178 of agitator 170 in order to allow one or more portions 178 to move independently of other portions 178 to prevent agitator 170 from becoming "jammed" in the event of a wellbore 30 failure. The structure and function of expansion joints 174 may be substantially similar to the structure and function of expansion joints 74 of FIG. 3. Similar to the discussion above, each portion 178 may be moved independently to move debris, such that the movement of successively more portions 78 of agitator 70, as they progress further into wellbore 30, becomes unrestricted, thereby helping to clear the obstructions, such as due to a wellbore 30 collapse, that may cause agitator 170 to "jam" within wellbore 30.

The structure and functionality of anchor 150 and teeth 152 can be substantially similar to the structure and functionality of anchor 50 and teeth 52 of FIGS. 1 and 2. Although teeth 152 are illustrated, any other suitable mechanism for securing anchor 150, and thereby anchoring agitator 170 within wellbore 30, may be used. For example, anchor 150 may comprise an inflatable "bladder" that is inserted into wellbore 30 in an un-inflated or under-inflated state and then inflated to secure anchor 150 within wellbore 30.

FIG. 4B illustrates the mixing of fines 100 with fluid contained in wellbore 30. In another example embodiment, agitator 270 may comprise a corkscrew- or helical-shaped tube or rod. In a particular embodiment, extensions 272 may be coupled to the corkscrew- or helical-shaped tube or rod to further facilitate mixing fines 100 with fluid contained in wellbore 30. In other embodiments, movement of agitator 270 relative to wellbore surface 32 may facilitate the movement of solids which may be substantially larger than fines 100, such as pieces of subterranean zone 15 which may fall into wellbore 30 as a result of a wellbore failure and restrict the flow of minerals or other resources in wellbore 30, to at least partially eliminate any restriction in the flow of minerals or other resources in wellbore 30. Coupler 260 may comprise a joint, such as a universal joint or a bearing, to facilitate the rotation of agitator 270 along its longitudinal axis 266. Drive mechanism 90 is coupled to agitator 270 and provides the rotational force which rotates agitator 270 to facilitate mixing fines 100 and fluid contained within wellbore 30, or moving large obstructions to prevent the wellbore flow path from being blocked, as described above.

The structure and functionality of anchor 250 and teeth 252 can be substantially similar to the structure and functionality of anchor 50 and teeth 52 of FIGS. 1 and 2. Although teeth 252 are illustrated, any other suitable mechanism for securing anchor 250, and thereby anchoring agitator 270 within wellbore 30, may be used. For example, anchor 50 may comprise an inflatable "bladder" that is inserted into wellbore 30 in an un-inflated or under-inflated state and then inflated to secure anchor 250 within wellbore 30. In certain embodiments, securing anchor 250 within wellbore 30 is optional.

FIG. 4C illustrates the mixing of fines 100 with fluid contained in wellbore 30. In another embodiment, agitator 370 may comprise a wire, cable, or the like coupled to drive mechanism 90. Linkage 360 may comprise a spring 375, similar to spring 75 of FIG. 3, coupled to anchor 350 and agitator 370. Linkage 360 may be covered in a protective covering 376, similar to protective covering 76 of FIG. 3, to prevent spring 375 from becoming clogged by debris, such as fines or solids, within wellbore 30. Drive mechanism 90 may be configured to move agitator 370 along its longitudinal axis 366, with the motion being assisted by the use of the spring comprising linkage 360. In a certain embodiment, agitator 370 may move in a "back-and-forth" motion along longitudinal axis 366. When the movement of agitator 370 is "retreating" in longitudinal direction 366*a*, spring 375 of linkage 360 may be extended with the spring force resulting from the extension assisting the "advancing" motion of agitator 370 in the opposite longitudinal direction 366*b*. In certain embodiments, workstring 40 may remain in place after anchor 350 is secured in wellbore 30 and act as a guide tube or conduit for an agitator 370.

Similar to the alternative configurations of agitator 370 discussed above, in the present embodiment, agitator 370 may comprise extensions 372 which facilitate the mixing of fines 100 with the fluid contained in wellbore 30. In other embodiments, movement of agitator 370 relative to wellbore surface 32 may facilitate the movement of solids which may be substantially larger than fines 100, such as pieces of subterranean zone 15 which may fall into wellbore 30 as a result of a wellbore failure and restrict the flow of minerals or other resources in wellbore 30, to at least partially eliminate any restriction in the flow of minerals or other resources in wellbore 30.

In certain embodiments, similar to the discussion above with respect to FIGS. 2–3, agitator 370 may include expansion joints 374 used to couple portions 378 of agitator 370 in order to allow one or more portions 378 to move independently of other portions 378 to prevent agitator 370 from becoming "jammed" in the event of a wellbore 30 failure. The structure and function of expansion joints 374 may be substantially similar to the structure and function of expansion joints 74 and 174 of FIGS. 3 and 4A, respectively. Similar to the discussion above, each portion 378 may be moved independently to move debris, such that the movement of successively more portions 378 of agitator 370, as they progress further into wellbore 30, becomes unrestricted, thereby helping to clear the obstructions, such as due to a wellbore 30 collapse, that may cause agitator 370 to "jam" within wellbore 30.

The structure and functionality of anchor 350 and teeth 352 can be substantially similar to the structure and functionality of anchor 50 and teeth 52 of FIGS. 1 and 2. Although teeth 352 are illustrated, any other suitable mechanism for securing anchor 350, and thereby anchoring agitator 370 within wellbore 30, may be used. For example, anchor 350 may comprise an inflatable "bladder" that is inserted into wellbore 30 in an uninflated or under-inflated state and then inflated to secure anchor 350 within wellbore 30.

Although example anchors are described, any other suitable mechanism for anchoring linkages and agitators, such as those illustrated in FIGS. 1, 2, and 4, within a wellbore may be implemented. In addition, although example linkages are described, any other suitable mechanism for coupling agitators to anchors, such as those illustrated in FIGS. 1, 2, and 4, may be implemented. Furthermore, although example agitators are described, any other suitable mechanism for agitating fines to facilitate mixing with the wellbore fluid or moving solids in wellbore 30 may be implemented to at least partially eliminate any restrictions in the flow of minerals or other resources.

Figure 5:
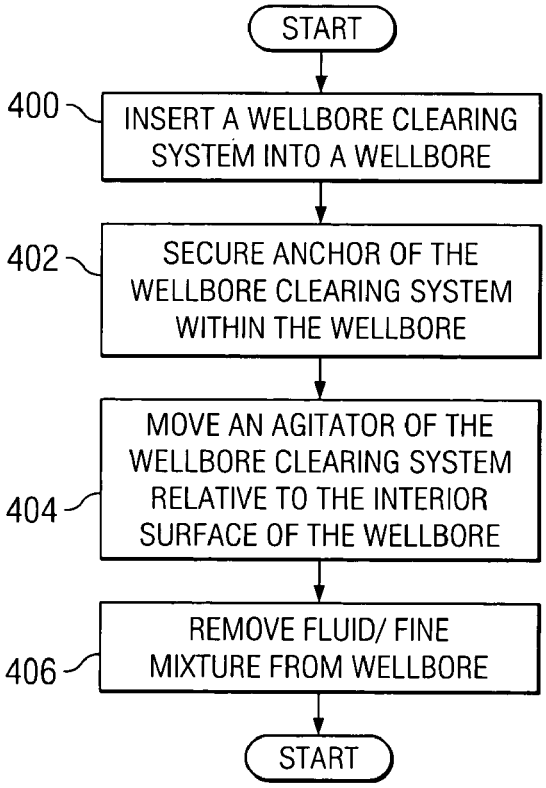
FIG. 5 is a flow chart illustrating an example method for wellbore clearing.

FIG. 5 illustrates an example method for wellbore clearing using a wellbore clearing system, such as system 10. The example method begins at step 400 where a wellbore clearing system, such as those described with reference to FIGS. 1 and 2, is inserted into wellbore 30. The wellbore clearing system may comprise an anchor, an agitator, and a linkage. At step 402, the anchor is secured within wellbore 30. In general, the anchor is positioned beyond the portion of wellbore 30 that is to be "cleared" using an agitator.

At step 404, the agitator is moved relative to surface 32 of wellbore 30, thereby facilitating the mixing of fines 100 with the fluid contained in wellbore 30, or in other embodiments, moving solids which may at least partially restrict the flow of minerals or other resources in wellbore 30. At step 406, the fluid and fine mixture and/or the solids are removed from wellbore 30. The removal of the fluid/fine mixture may be accomplished through the fluid flow of the water and/or gas mixed with fines 100 from the subterranean zone. In certain embodiments, the fluid/fine mixture may be removed through the pumping of water mixed with fines 100 from the subterranean zone.

Although an example method is illustrated, the present invention contemplates two or more steps taking place substantially simultaneously or in a different order. In addition, the present invention contemplates using methods with additional steps, fewer steps, or different steps, so long as the steps remain appropriate for using a wellbore clearing system, such as system 10, for removing fines or clearing obstructions from a well system, such as system 12.

Furthermore, although the present invention has been described with several embodiments, a multitude of changes, substitutions, variations, alterations, and modifications may be suggested to one skilled in the art, and it is intended that the invention encompass all such changes, substitutions, variations, alterations, and modifications as fall within the spirit and scope of the appended claims.

What is claimed is:

1. A system for clearing the inside of a wellbore, comprising:

an anchor adapted to be positioned within the wellbore;

an agitator coupled to the anchor, the agitator operable to move relative to the interior surface of the wellbore, the movement of the agitator operable to at least partially eliminate a restriction to a flow of minerals or other resources in the wellbore;

a linkage adapted to couple the agitator to the anchor;

a drive mechanism coupled to the agitator and operable move the agitator relative to the interior surface of the wellbore; and wherein the drive mechanism is operable to move the agitator longitudinally relative to the interior surface of the wellbore.

2. The system of claim 1, wherein movement of the agitator operable to at least partially eliminate a restriction to a flow of minerals or other resources in the wellbore comprises moving the agitator to mix fines contained within the wellbore with fluid contained in the wellbore to facilitate removal of the fines from the wellbore.

3. The system of claim 2, wherein the agitator comprises a plurality of extensions operable to facilitate mixing the fines with the fluid contained in the wellbore.

4. The system of claim 1, wherein movement of the agitator operable to at least partially eliminate a restriction to a flow of minerals or other resources in the wellbore comprises moving the agitator to facilitate movement of solids within the wellbore.

5. The system of claim 4, wherein the agitator comprises a plurality of extensions operable to facilitate moving the solids contained in the wellbore.

6. The system of claim 1, wherein the agitator comprises:

one or more agitator portions; and one or more expansion joints coupling the agitator portions and operable to allow relative independent movement of each agitator portion.

7. The system of claim 1, wherein the wellbore comprises an articulated wellbore.

8. The system of claim 1, wherein the wellbore comprises a pipe.

9. The system of claim 1, wherein the anchor is positioned in the wellbore using a workstring adapted to be removably coupled to the anchor.

10. The system of claim 1, wherein the agitator is selected from the group consisting of a belt, a wire, a cable, a chain, a corkscrew-shaped rod, a corkscrew-shaped tube, a helical-shaped rod, and a helical-shaped tube.

11. The system of claim 1, wherein the linkage comprises a pulley operable to rotate in response to movement of the agitator.

12. The system of claim 1, wherein the linkage comprises a spring coupled to the anchor, the spring adapted to facilitate longitudinal motion of the agitator relative to the surface of the wellbore.

13. The system of claim 1, wherein the anchor is secured within the wellbore using teeth coupled to the anchor, the teeth adapted to be extended from the anchor to engage the interior surface of the wellbore.

14. The system of claim 1, wherein the anchor is secured within the wellbore by inflating the anchor to fill at least a portion of the wellbore.

15. The system of claim 1, wherein the drive mechanism comprises a hand-operated crank.

16. The system of claim 1, wherein the drive mechanism comprises a motor.

17. The system of claim 1, wherein the drive mechanism is operable to rotate the agitator relative to the interior surface of the wellbore.

18. A system for clearing the inside of a wellbore, comprising:

an anchor adapted to be positioned within the wellbore;

an agitator coupled to the anchor, the agitator operable to move relative to the interior surface of the wellbore, the movement of the agitator operable to at least partially eliminate a restriction to a flow of minerals or other resources in the wellbore;

a linkage adapted to couple the agitator to the anchor;

a drive mechanism coupled to the agitator and operable move the agitator relative to the interior surface of the wellbore; and wherein the linkage comprises a joint operable to rotate relative to the anchor, the joint operable to facilitate the rotation of the agitator in the wellbore.

19. A method for clearing the inside of a wellbore, comprising:

inserting a wellbore clearing system into the wellbore, the wellbore clearing system comprising an anchor adapted to be positioned within the wellbore, an agitator operable to be moved relative to the interior surface of the wellbore, and a linkage coupling the agitator to the anchor;

securing the anchor within the wellbore;

moving the agitator relative to the interior surface of the wellbore, the movement of the agitator operable to at least partially eliminate a restriction to a flow of minerals or other resources in the wellbore; and wherein the wellbore comprises an articulated wellbore.

20. The method of claim 19, wherein moving the agitator to at least partially eliminate a restriction to a flow of minerals or other resources in the wellbore comprises moving the agitator to mix fines contained within the wellbore with fluid contained in the wellbore to facilitate removal of the fines from the wellbore.

21. The method of claim 20, wherein the agitator comprises a plurality of extensions operable to facilitate mixing the fines with the fluid contained in the wellbore.

22. The method of claim 20, further comprising removing the fluid/fine mixture from the wellbore.

23. The method of claim 22, wherein the fluid/fine mixture is removed from the wellbore through fluid flow of the fluid mixed with the fines from a subterranean zone.

24. The method of claim 19, wherein moving the agitator to at least partially eliminate a restriction to a flow of minerals or other resources in the wellbore comprises moving the agitator to facilitate movement of solids within the wellbore.

25. The method of claim 24, wherein the agitator comprises a plurality of extensions operable to facilitate movement of the solids contained in the wellbore.

26. The method of claim 19, wherein the agitator comprises:

one or more agitator portions; and one or more expansion joints coupling the agitator portions and operable to allow relative independent movement of each agitator portion.

27. The method of claim 19, further comprising:

removably coupling a workstring to the anchor; and positioning the anchor within the wellbore using the workstring.

28. The method of claim 27, further comprising disengaging the workstring from the anchor once the anchor is secured within the wellbore and removing the workstring from the wellbore.

29. The method of claim 27, further comprising recoupling the workstring to the anchor and removing the anchor and agitator from the wellbore.

30. The method of claim 19, wherein the wellbore comprises a pipe.

31. The method of claim 19, wherein securing the anchor within the wellbore comprises extending teeth from the body of the anchor, the teeth adapted to engage the interior surface of the wellbore.

32. The method of claim 19, wherein securing the anchor within the wellbore comprises inflating the anchor to fill at least a portion of the wellbore.

33. The method of claim 19, wherein the agitator is selected from the group consisting of a belt, a wire, a cable, a chain, a corkscrew-shaped rod, a corkscrew-shaped tube, a helical-shaped rod, and a helical-shaped tube.

34. The method of claim 19, wherein the linkage comprises a spring coupled to the anchor, the spring adapted to facilitate longitudinal motion of the agitator relative to the surface of the wellbore.

35. The method of claim 19, wherein the linkage comprises a joint operable to rotate relative to the anchor, the joint operable to facilitate the rotation of the agitator in the wellbore.

36. The method of claim 19, wherein the linkage comprises a pulley adapted to rotate in response to movement of the agitator.

37. The method of claim 19, wherein the agitator is moved using a drive mechanism.

38. The method of claim 37, wherein the drive mechanism comprises a hand-operated crank.

39. The method of claim 37, wherein the drive mechanism comprises a motor.

40. The method of claim 37, wherein the drive mechanism is operable to rotate the agitator relative to the interior surface of the wellbore.

41. The method of claim 37, wherein the drive mechanism is operable to move the agitator longitudinally relative to the interior surface of the wellbore.

42. A method for clearing the inside of a wellbore, comprising:

inserting a wellbore clearing system into the wellbore, the wellbore clearing system comprising an anchor adapted to the positioned within the wellbore, an agitator operable to be moved relative to the interior surface of the wellbore, and a linkage coupling the agitator to the anchor;

securing the anchor within the wellbore;

moving the agitator relative to the interior surface of the wellbore, the movement of the agitator operable to at least partially eliminate a restriction to a flow of minerals or other resources in the wellbore;

wherein moving the agitator to at least partially eliminate a restriction to a flow of minerals or other resources in the wellbore comprises moving the agitator to mix fines contained within the wellbore with fluid contained in the wellbore to facilitate removal of the fines from the wellbore;

removing the fluid/fine mixture from the wellbore; and wherein the fluid/fine mixture is removed from the wellbore through the pumping of water mixed with the fines from a subterranean zone.

43. A system for clearing the inside of a wellbore, comprising:

a first means operable to move relative to the interior surface of the wellbore, the movement of the first means operable to at least partially eliminate a restriction to a flow of minerals or other resources in the wellbore;

a second means operable to anchor the first means within the wellbore, the second means coupled to the first means;

a third means operable to couple the first means to the second means, the third means adapted to allow the first means to be moved relative to the interior surface of the wellbore; and a fourth means operable to move the first means relative to the interior surface of the wellbore, the fourth means coupled to the first means; and the fourth means operable to move the first means relative to the interior surface of the well bore.

* * * * *